US005744190A

United States Patent [19]

Thome

[11] Patent Number: 5,744,190

[45] Date of Patent: Apr. 28, 1998

[54] PROCESS AND DEVICE FOR SPRAYING A COATING PRODUCT

[75] Inventor: Caryl Thome, Saint-Egreve, France

[73] Assignee: Sames S.A., Meylan, France

[21] Appl. No.: 559,087

[22] Filed: Nov. 17, 1995

[30] Foreign Application Priority Data

Nov. 18, 1994 [FR] France ..... 94 14047

[51] Int. Cl.[6] ..... B05D 1/02; B05C 11/00

[52] U.S. Cl. ..... 427/8; 427/424; 118/679; 118/712

[58] Field of Search ..... 427/8, 421; 118/712, 118/663, 679, 680, 683

[56] References Cited

U.S. PATENT DOCUMENTS 4,431,690 2/1984 Matt et al. ..... 427/424

4,564,410 1/1986 Clitheros et al. ..... 156/356

5,310,120 5/1994 Ehinger et al. ..... 239/708

FOREIGN PATENT DOCUMENTS 2561947 10/1985 France ..... 118/679

*Primary Examiner*—Donald E. Czaja

*Assistant Examiner*—Calvin Padgett

*Attorney, Agent, or Firm*—Loeb & Loeb LLP

[57] ABSTRACT

In a process and device for spraying a coating product onto an article from a sprayer to which coating product is supplied from a reservoir equipped with a piston which is moved along a path in order to transport the coating product to the sprayer, movement of the piston is controlled as a function of movement of the sprayer relative to the article.

11 Claims, 3 Drawing Sheets

PROCESS AND DEVICE FOR SPRAYING A COATING PRODUCT

BACKGROUND OF THE INVENTION

The present invention concerns a process and device for spraying a coating product utilized, particularly, in plants where delivery of the coating product is performed from a reservoir which contains a piston. In conventional coating plants, the rate of delivery of the coating product is sometimes controlled as a function of the speed of the conveyor which transports the articles to be coated such as automotive vehicle bodies. A calculator determines, at given time intervals of the order of several seconds and as a function of the speed of the conveyor, a desired value for the rate of flow of paint which must be delivered to a sprayer during the subsequent time interval. In the case of supplying a sprayer from a piston-type reservoir, the speed of displacement of the piston is controlled as a function of the speed of displacement of the articles. In practice, the precision of the speed of conveyance of the vehicle bodies is as significant for the surface state obtained as is the precision of the delivery of coating product furnished to the sprayer.

Now, it occurs that the measurement of the speed of the conveyor is imprecise or that the conveyor speed varies in an uncontrolled manner, which produces errors in the supply of product furnished to the sprayer and, as a result, irregularities in the coating which can produce defects in appearance. In addition, it occurs that the conveyor must, for safety reasons, be capable of being halted in the event of emergencies during a coating process. The response times are such that a poorly controlled quantity of paint is projected onto an article during the emergency stopping, which leads, on the one hand, to a waste of the product and, on the other hand, to the formation of an added thickness of paint which is prejudicial to the surface state.

Equivalent problems appear in plants where the articles to be coated are stationary during the spraying phases and where the sprayers are movable along or around the articles, for example in the case where a sprayer is carried by a multiaxial robot.

The invention solves the totality of these problems.

SUMMARY OF THE INVENTION

The invention provides a process for spraying a coating product from at least one sprayer supplied with a coating product from a piston-type reservoir, characterized in that the position of the piston in the reservoir is controlled by the relative position of the sprayer with respect to the articles to be coated.

The invention also provides a device capable of carrying out the process and more precisely a device for spraying the coating product onto articles transported by a conveyor, the device comprising a sprayer supplied with a coating product from a reservoir of the piston type, characterized in that the device comprises means for controlling the position of the reservoir piston on the basis of the position of the sprayer with respect to the articles.

As a result of the process and device according to the invention, a coating plant is not disturbed by variations in the speed of the conveyor of the plant and/or by emergency stops.

The invention is applicable to the case where the articles to be coated move in front of the sprayer, which is itself possibly movable, or where the articles are stationary during the coating phases and the sprayer is movable, for example carried by the arm of a multiaxial robot. In the first case, the sprayer can be carried by a lateral machine or a roof machine.

The invention will be better understood and other advantages thereof will appear more clearly from the description which follows of two embodiments of a plant for spraying a coating product according to the principals of the invention, given solely by way of example and described with reference to the attached drawings.

DESCRIPTION OF THE PREFERRED EMBODIMENTS

Figure 1:
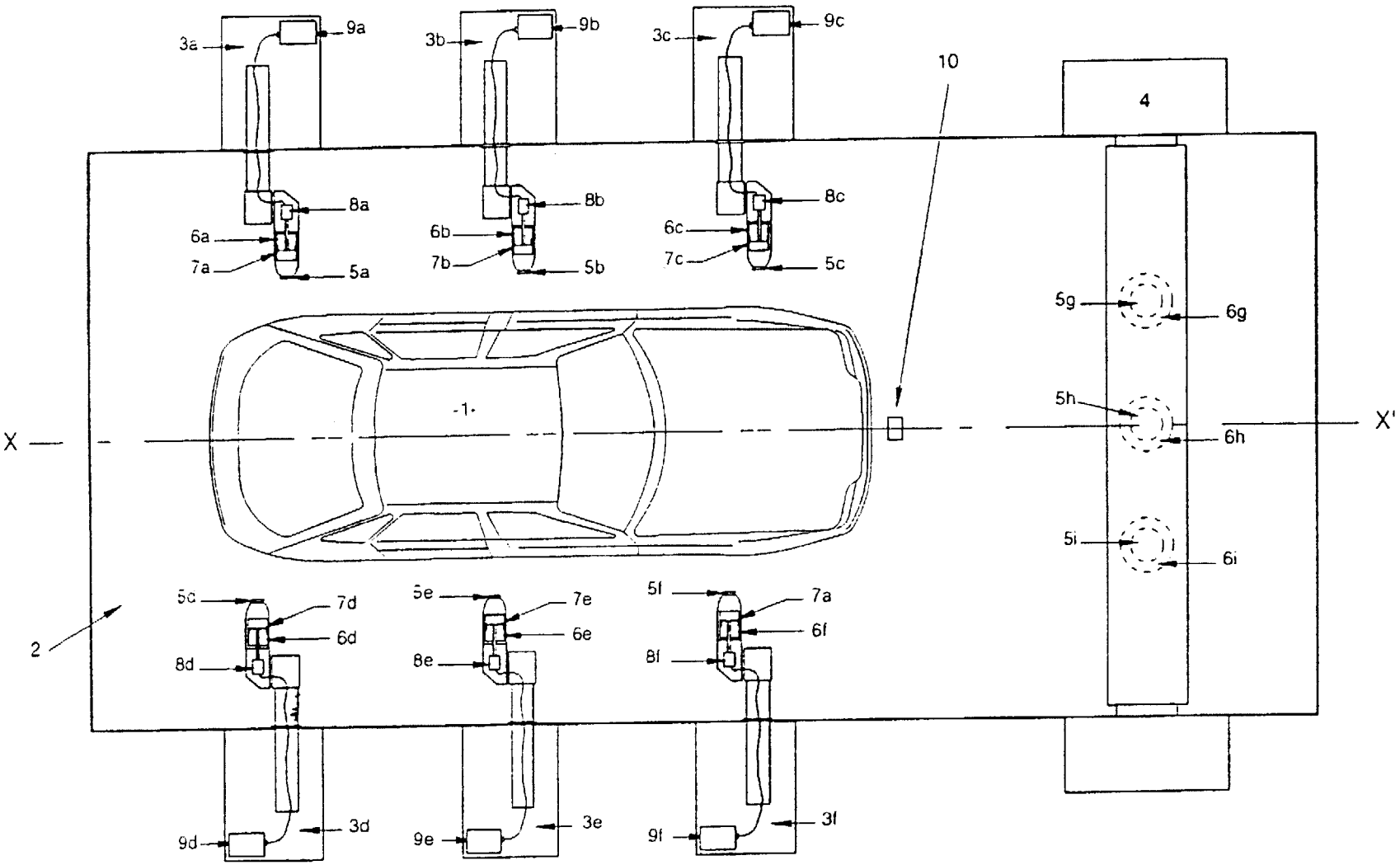
FIG. 1 is a schematic plan view of a coating product spraying plant according to the invention.

The plant shown in FIG. 1 includes a conveyor (not shown) for displacing articles, such as automotive vehicle bodies 1, in translation in a booth 2 along an axis X–X'. It comprises essentially several lateral machines 3*a*–3*f* and a roof machine 4. Each of these machines carries at least one sprayer 5*a*–5*i*, respectively, supplied with a coating product from a respective piston-type reservoir 6*a*–6*i*. The reservoir 6*a* of the machine 2*a* includes a piston 7*a* controlled by an electric stepping motor 8*a*, piston 7*a* being operative to push coating product out of reservoir 6*a* toward sprayer 5*a*. Motor 8*a* is controlled by a conventional numerical machine control 9*a* connected to an automatic controller (not shown).

The position of pistons 7*a* in reservoir 6*a* is determined by displacement of piston 7*a* on a path parallel to its longitudinal axis. The position of body 1 along axis X–X' is measured by a conventional sensor 10 placed along the path of travel of bodies 1 and whose output is connected to the machine control. According to the invention, the position of piston 7*a* is determined by the numerical machine control 9*a* as a function of the position of body 1 along axis X–X'. More specifically, a pulse is supplied by the sensor 10 to the machine control system for each centimeter of displacement of body 1 or of the conveyor. With an average conveyor speed of 4 meters per minute, a pulse is supplied every 150 ms. After each conveyor displacement pulse received, the automatic control device interpolates the average assigned, or desired, value for the position of piston 7*a* which is transmitted to the numerical control 9*a* and to the motor 7*a*.

The operation of all of the other machines is the same.

The function having for its independent variable the position of body 1 along axis X–X' and for its dependent variable the position of the piston is a monotonically increasing function. In addition, if body 1 should move backwards along axis X–X', i.e. the direction of its movement reverses, the piston is halted and maintained in position until body 1 returns to the position where it was located before the direction of its movement was reversed. Possibly, the connection between the piston and its drive rod is of the type disclosed in French Application 9408930 filed by Applicant and the entirety of which is incorporated herein by reference.

Figure 2:
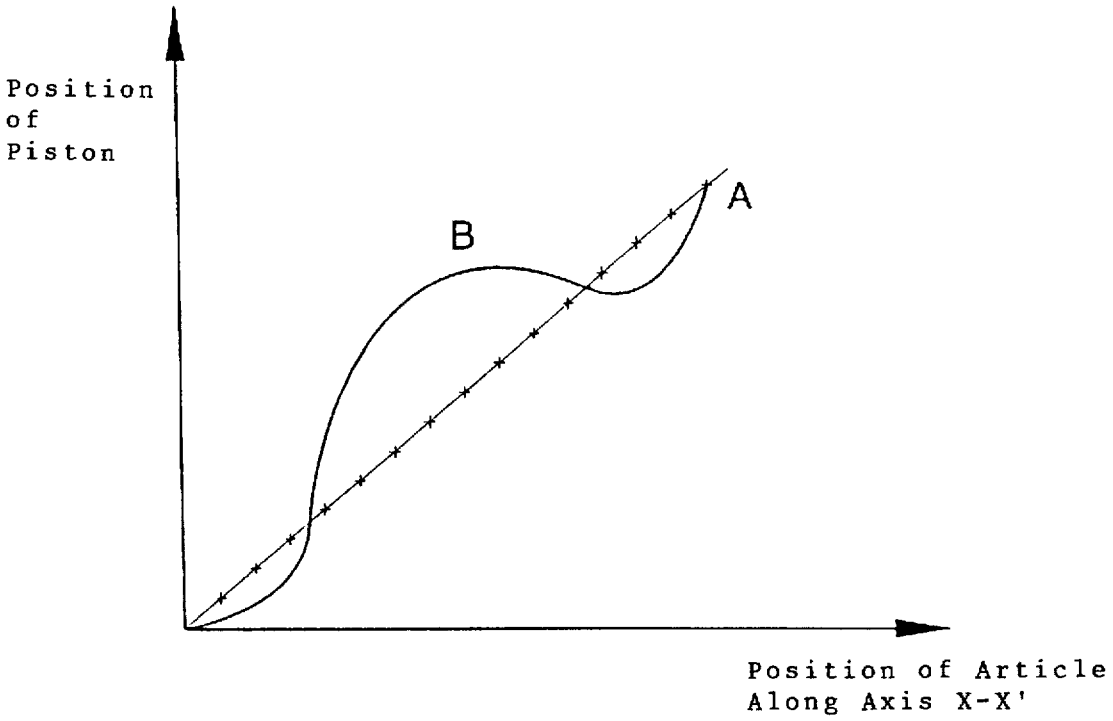
FIG. 2 is a graph showing the position of a reservoir piston as a function of the position of car bodies along the axis X–X' of FIG. 1.

Examples of curves representative of the position of the piston with respect to advancing movement of body 1 along axis X–X', represented by the sensor pulses, are shown in FIG. 2. Curve A is used when a linear relation is to exist between the sensor pulses and the displacement of the piston. The scale coefficient is constant and is of the order of 0.0375 because the piston has a total travel path of the order of 150 mm during the time when body 1 covers a path length of 4 meters. Curve B has a variable scale coefficient which is determined experimentally as a function of the desired thickness of the coating product and of the dimension of the surfaces to be painted perpendicular to their displacement on the conveyor. Thus, the position of the piston at the middle of body 1 varies rapidly because the entire height of the vehicle body is to be painted while at the beginning and end of the coating operation of one vehicle body, the body is painted just to the top of the fenders; i.e. to the middle of its maximum height.

Figure 3:
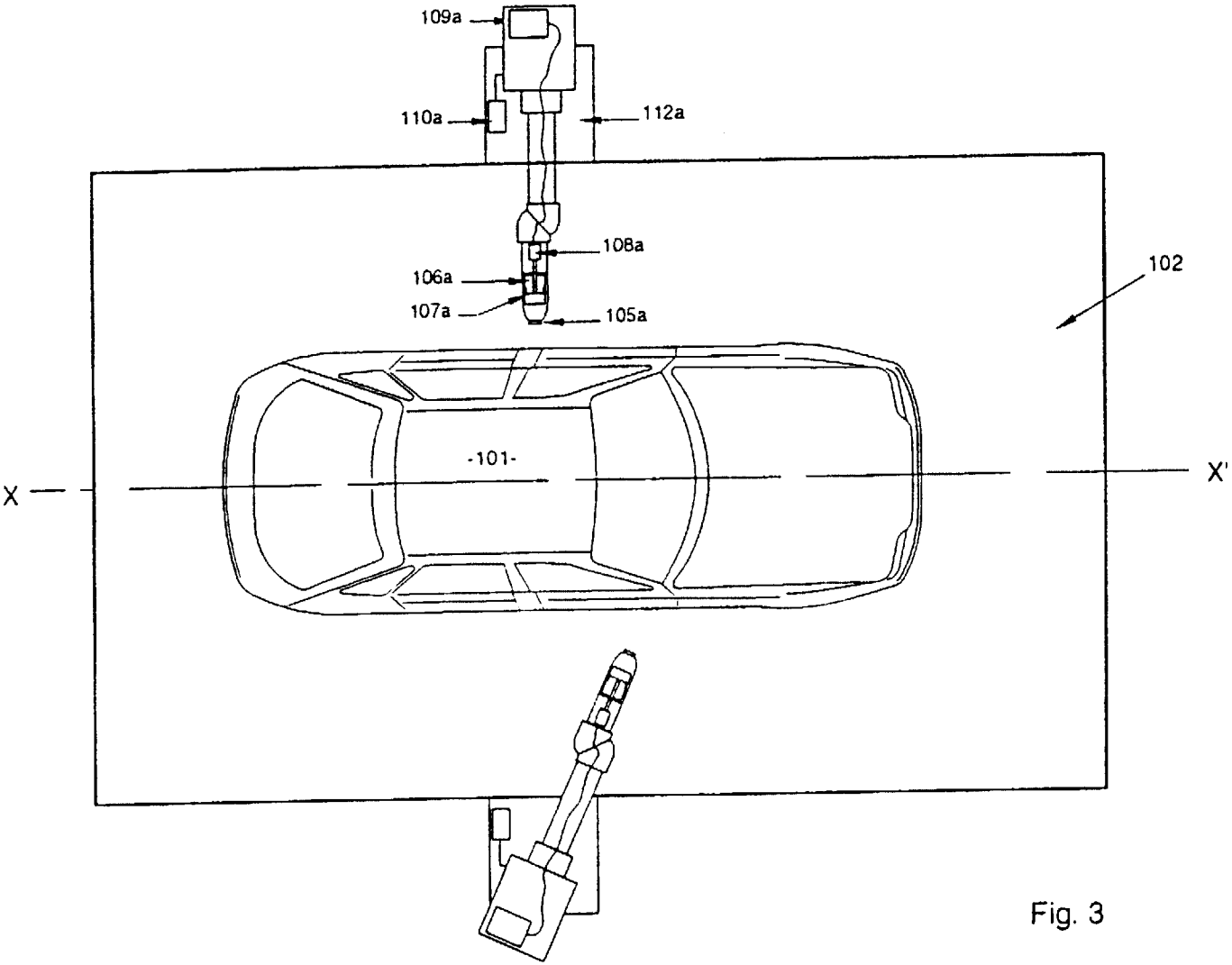
FIG. 3 is a schematic plan view of another coating product spraying plant.

The plant shown in FIG. 3 differs from that of FIG. 1 in that the conveyor is of the stop-and-go type and in that sprayer 105*a* is mounted to undergo movements parallel to the axis X–X', here mounted on a multiaxial robot 112*a*. Elements similar to those of FIG. 1 carry identical reference numerals increased by 100. Body 101 being fixed in booth 102 during the coating product spraying operations, the relative position of the sprayer with respect to body 101 is known by a measurement of the position of sprayer 105*a* in booth 102, i.e. the position of the end of the arm of robot 112*a*. Sensor 10 of the embodiment of FIG. 1 can advantageously be replaced by a position coder 110*a* or an assembly of position coders placed in proximity to the joints of multiaxial robot 112*a*. As previously, control of the position of piston 107*a* in reservoir 106*a* is possible with the aid of a numerical machine control device 109*a* which controls an electric stepping motor 108*a*.

This application relates to subject matter disclosed in French Application number 94 14047, filed on Nov. 18, 1994, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. In a process for spraying a coating product onto an article from a sprayer to which coating product is supplied from a reservoir equipped with a piston which is moved along a path in order to transport the coating product to the sprayer, wherein the sprayer is positionable at any one of a plurality of positions relative to the article and the piston is positionable at any one of a plurality of positions along the path, each position of the piston corresponding to the position of the sprayer relative to the article the improvement comprising: sensing the position of the sprayer relative to the article and providing an indication of that position; and controllably placing the piston at a position along the path which corresponds to the position of the sprayer relative to the article, in response to the position indication provided in said sensing step.

2. A process according to claim 1 further comprising displacing the article in translation by a conveyor along an axis.

3. A process according to claim 2 wherein said step of displacing is carried out to displace the article in translation during a spraying period and said step of controllably placing the piston is effected with respect to the position of a point on the article along the axis.

4. A process according to claim 2 wherein the article is stationary in a spray booth during a spraying period and further comprising moving the sprayer relative to the article and parallel to the axis during the spraying period.

5. A process according to claim 4 wherein said step of controllably placing the piston is effectuated with respect to the position of the sprayer in the spray booth.

6. A process according to claim 1 wherein said step of placing the piston comprises detecting the position of the sprayer relative to the article, and controllably placing the piston along the path in response to the detection of the position of the sprayer relative to the article.

7. In a device for applying a coating to an article, which device includes a conveyer for conveying the article, a sprayer positioned and arranged for spraying a coating product onto the article, and a reservoir positioned and arranged for containing coating product and equipped with a piston which is movable along a path to transport the coating product from the reservoir to the sprayer, wherein the sprayer is positionable at any one of a plurality of positions relative to the article and the piston is positionable at any one of a plurality of positions along the path, each position of the piston corresponding to one position of the sprayer relative to the article the improvement comprising: a sensor means positioned and arranged for sensing the position of said sprayer relative to the article and for providing an indication of that position and a control means coupled to said means and responsive to the indication provided by said sensor means for placing said piston at a position along the path which corresponds to the position of said sprayer relative to the article.

8. A device according to claim 7 wherein said sensor means comprise at least one displacement sensor disposed for sensing the position of a point on the articles or the sprayer parallel to an axis.

9. A device according to claim 7 further comprising an electric stepping motor coupled to said piston for moving said piston along the path.

10. A device according to claim 9 wherein said control means further comprises numerical control means connected to said motor for operating said motor according to a nonlinear function of movement of said sprayer relative to the article.

11. A device according to claim 10 wherein the coating is to have a desired thickness and the non linear function has a value dependent on the desired thickness.

* * * * *